United States Patent [19]

Pelsue et al.

[11] 4,285,269

[45] Aug. 25, 1981

[54] PORTABLE VENTILATING APPARATUS FOR PURGING UNDERGROUND INSTALLATIONS AND THE LIKE

[75] Inventors: Bradley A. Pelsue, Lakewood; Allan E. Beavers, Littleton, both of Colo.

[73] Assignee: T. A. Pelsue Company, Englewood, Colo.

[21] Appl. No.: 886,048

[22] Filed: Mar. 13, 1978

[51] Int. Cl.[3] ..... F24F 13/00

[52] U.S. Cl. ..... 98/33 R; 98/49; 98/40 C; 98/40 N

[58] Field of Search ..... 98/33 R, 40 C, 40 N, 98/50, 39, 32, 49, 62, 61; 239/273, 279; 114/211; 417/89

[56] References Cited

U.S. PATENT DOCUMENTS

| | | | |
|---|---|---|---|
| 73,957 | 6/1893 | Stauber | 114/211 |
| 592,468 | 10/1897 | Harris | 114/211 |
| 2,291,546 | 7/1942 | George | 98/40 C |
| 3,610,524 | 10/1971 | Wallen | 98/33 |
| 3,943,329 | 3/1976 | Hlavac | 417/89 |

FOREIGN PATENT DOCUMENTS

| | | | |
|---|---|---|---|
| 1120261 | 4/1956 | France | 98/50 |

*Primary Examiner*—Edward G. Favors
*Assistant Examiner*—Henry Bennett
*Attorney, Agent, or Firm*—Edwin L. Spangler, Jr.

[57] ABSTRACT

This invention relates to a portable ventilating apparatus particularly well suited for use in purging underground installations characterized by a collar having a deflector atop thereof mountable within an entryway on the surface leading below ground, a duct hanging from the underside of the collar extendable well down into the area to be ventilated in spaced relation to the entryway so as to leave an annular exhaust passage therebetween, a tapered nozzle supported within the mouth of the collar cooperating with the deflector to define an annular air intake passage, and a blower mounted within the nozzle for directing a stream of air down the duct, said blower and nozzle cooperating to inspirate clean air into the duct through the air intake passage and using it to force any foul air out through the exhaust opening across the deflector which disperses it and thus prevents the latter from being returned underground.

2 Claims, 5 Drawing Figures

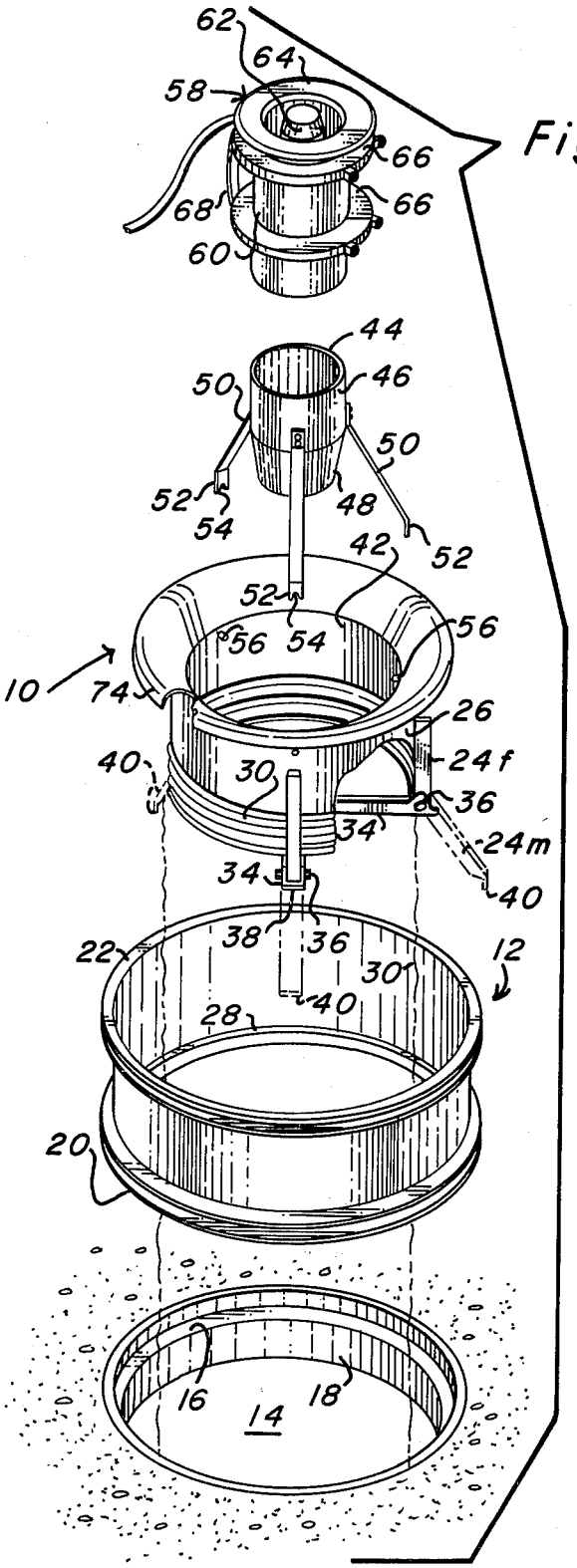
Fig.-1
Fig.-2
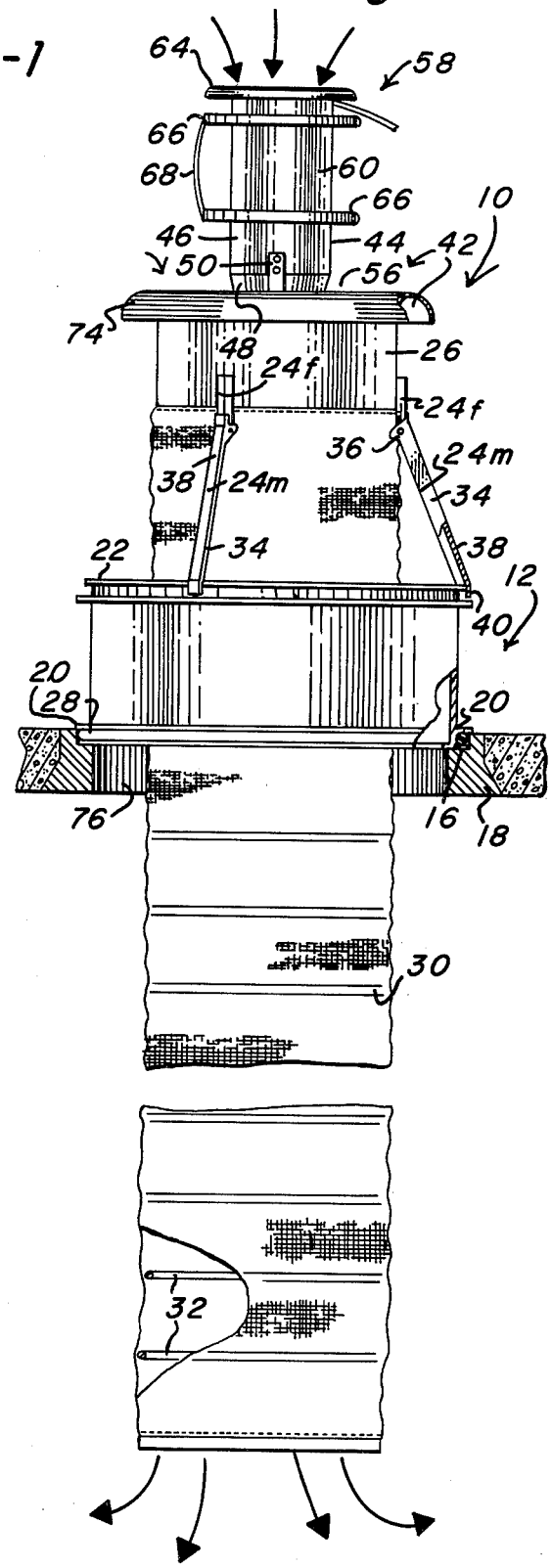

PORTABLE VENTILATING APPARATUS FOR PURGING UNDERGROUND INSTALLATIONS AND THE LIKE

The operating companies of the Bell System, among others, require that their underground installations be purged with fresh air before personnel are allowed to enter them in case noxious or explosive gases are present. This operation is ordinarily carried out with a small electric or gasoline driven blower and a long hose. Purging the installation of foul air in this way takes a good deal of time, especially if the installation is a large one which many of them are. All the while that the installation is being purged, highly paid workmen are forced to sit around doing little or nothing of a constructive nature until the facility is safe to enter. For this reason, therefore, it would be highly advantageous to have some more efficient way of purging underground installations of foul air.

While the instant apparatus was developed with the aforementioned needs in mind, its use is by no means confined to such applications. In fact, considerable interest has been shown recently in the use of the equipment to disperse noxious volatile chemical agents and the like, especially those heavier than air, that tend to settle and remain in highly concentrated form in even open spaces. Nevertheless, the apparatus forming the subject matter hereof realizes its maximum potential utility in the purging of confined underground spaces and it is in this environment that its use will be detailed.

It has now been found in accordance with the teaching of the instant invention that this very necessary safety precaution can, in fact, be handled more expeditiously and efficiently through the use of a novel forced-draft chimney-like apparatus designed to operate within the entryway to the subsurface installation, the latter usually taking the form of a so-called manhole. The purging apparatus is fully portable and can be set up as well as taken down and stored in a matter of a very few minutes. Not only is it lightweight and easily handled by one man but, in addition, it folds into a very compact package for stowage aboard the service truck. Even the foldable legs that are used to mount the duct-supporting collar within the mouth of the open manhole function in folded position to retain the collapsible duct in stowed condition.

The blower itself is of conventional design although the housing therefor has some unique features which materially contribute to its versatility and utility for other operations requiring forced air movement. While the blower itself is not unique, the results it achieves are when it is used in combination with the uniquely shaped collar and nozzle subassemblies to aspirate fresh air into the underground installation while, at the same time, driving the foul air out far faster than the same size blower could ever do so by conventional methods.

While the collar and nozzle cooperate with one another and with the blower to aspirate fresh air down into the manhole, a deflector rimming the collar functions to disperse the foul air thus preventing it from being sucked back underground.

One other noteworthy aspect of the instant purging apparatus is the fact that it is readily adaptable for use in both the common size manholes in use here in the United States. Moreover, the unit integrates perfectly with the manhole shield that forms the subject matter of U.S. Pat. No. 3,294,000.

Accordingly, it becomes the principal object of the present invention to provide a novel and improved apparatus for removing foul air from underground installations.

A second objective is the provision of equipment of the type aforementioned which accomplishes the purging function more efficiently and quickly than other forced air blowers of comparable size.

Another object is to provide downhole air purging equipment which is completely portable and which can be set up as well as dismantled in a matter of minutes by a single unskilled operator.

Still another objective is to provide forced air purging apparatus for use in open manholes that readily adapts to different sizes of the latter while, at the same time, integrating with ring-like shields often used therein.

An additional object is the provision of purging apparatus for evacuating foul air from underground installations through an entryway thereto which includes means adapted to disperse the air thus evacuated so as to prevent the return of appreciable amounts thereof with the fresh air entering same.

Further objects are to provide a system for exchanging contaminated air with fresh air in an underground installation which is simple, lightweight, compact, safe, rugged, dependable, easy to use, free of service problems and even somewhat decorative in appearance. Other objects will be in part apparent and in part pointed out specifically hereinafter in connection with the description of the drawings that follows, and in which:

FIG. 1 is an exploded perspective view showing the manhole purging apparatus of the present invention being used with a previously patented manhole shield inside a conventional manhole;

FIG. 2 is an elevation to a somewhat larger scale than FIG. 1 showing the apparatus and associated shield in assembled relation inside the manhole, portions of the duct and duct-supporting collar having been broken away to expose the interior construction;

Figure 3:
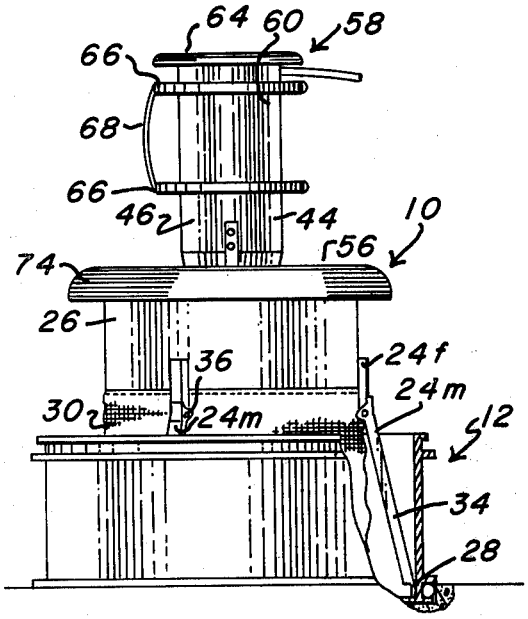
FIG. 3 is a fragmentary elevation similar to FIG. 2 and to the same scale showing the purging apparatus resting on an internal shoulder of the shield instead of the rim thereof.
Figure 4:
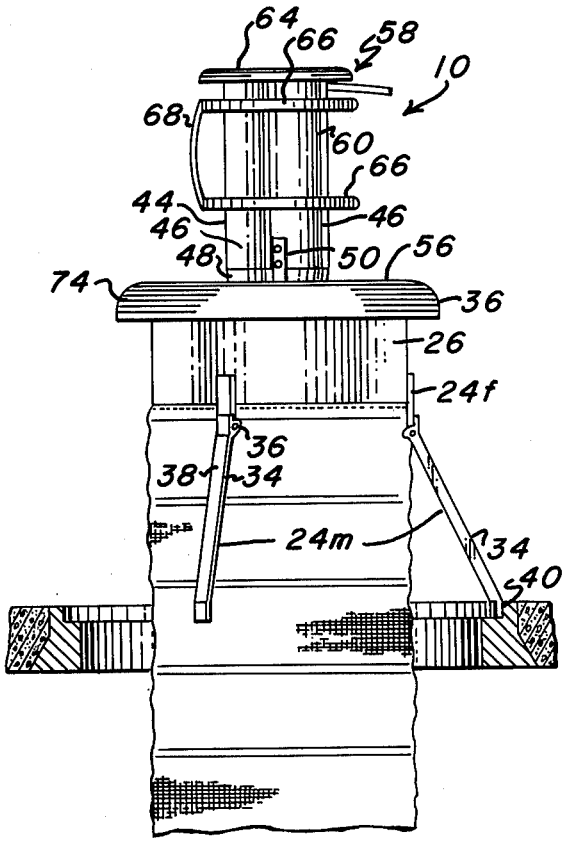
Figure 5:
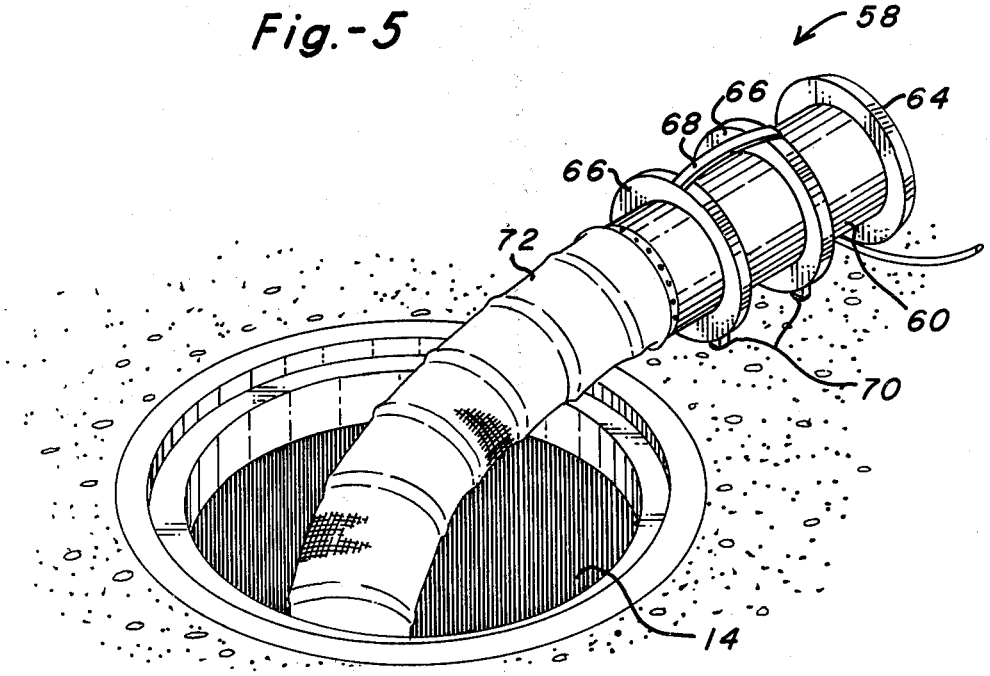

FIG. 4 is a fragmentary elevational view like FIGS. 2 and 3 and to the same scale but differing therefrom in that the purging apparatus is shown mounted directly in the manhole and the shield has been eliminated altogether; and, FIG. 5 is a perspective view to approximately the same scale as FIGS. 2, 3 and 4 showing the blower subassembly sitting on the ground by itself with a hose attached thereto supplying fresh air to the underground installation after the latter has been purged.

Referring next to the drawings for a detailed description of the present invention and, initially, to FIGS. 1–4 for this purpose, reference numeral 10 has been chosen to broadly designate the purging assembly in its entirety while numeral 12 similarly designates the patented manhole shield with which it is often used. The manhole 14 defines an entryway into an underground installation which, quite often, houses telephone lines and other utilities. It is ordinarily closed by a removable cover (not shown) which rests atop an upwardly-facing circular ledge 16 formed in the upper inside edge of ring 18 that borders the manhole. In FIGS. 1, 2 and 3, this ledge 16 is shown supporting the manhole shield in the manner of FIG. 2 of Pelsue's U.S. Pat. No. 3,294,000; whereas, in FIG. 4, this same ledge 16 supports the purging apparatus directly. Both ends of the manhole shield are bordered by a peripheral flange, the one 20 on the bottom being somewhat smaller than the one on the top 22 thus accommodating the two different sizes of manholes in common use in this country. Flange 20 rests on the ledge 16 of the smaller of the two manhole rings 18 as shown while the larger flange 22 performs a similar function within the larger rings (not shown). Regardless of which way the shield is used, there is always a peripheral flange 20 or 22 available on top to support the foldable legs 24 of collar 26 as shown in FIGS. 1 and 2.

While on the subject of how the collar can be used with the shield, reference to FIG. 3 will reveal that when the shield is mounted small end down in a small diameter manhole, an upwardly-facing annular ledge 28 exists upon which the foldable legs 24 of the collar can rest when partially folded. The only difference between the arrangement shown in FIG. 2 and that of FIG. 3, therefore, being that in the latter the legs are recessed down inside the shield thus lowering the whole assembly while in the former it is raised up a good deal higher.

Returning again to FIGS. 1 and 2, it will be seen that the movable limb 24*m* of the foldable leg is pivotally attached to the fixed limb 24*f* thereof such that it can be folded inwardly into the stored or inoperative position shown in full lines in FIG. 1. The three legs when thus folded underlie the duct 30 and support same in its collapsed or folded position shown in FIG. 1. While a rigid-walled duct can be used with no loss in efficiency, the foldable one shown has the distinct advantage of increased compactness and portability. It is fabricated from a foldable sheet material preferably rendered essentially impervious to air by a suitable coating or impregnation, such treatments being commonplace. When the duct is unfolded in its operative position shown in all but FIG. 5, it is significant that it retain its chimney-like open configuration and not be free to flap around and change shape under the influence of the rather high velocity airstreams moving down through the inside thereof and exiting around the outside. Thus, to maintain its generally tubular configuration, a series of rigid hoops 32 are fastened thereto in spaced essentially parallel relation to one another throughout the length thereof. While the convolutions of a loose wound spring-like member would serve the same function, the individual hoops are preferable because they render the duct somewhat easier to fold up into the collapsed relation shown in full lines in FIG. 1.

The upper end of the duct is permanently attached to the bottom end of the collar as shown. The fixed limbs 24*f* of the legs project a distance beneath the lower end of the collar sufficient to accommodate the duct in collapsed position. The resulting subassembly comprising the collar 26, its foldable legs 24 and duct 30 all cooperate to produce an extremely compact arrangement that can be collapsed and stored away on a service truck in less time than it takes to describe the operation.

One remaining aspect of the collar, leg and duct subassembly should, perhaps, be described at this point and that is the fully unfolded condition of the legs shown in FIGS. 1 and 2 to which detailed reference will, once again, be made. The movable limb 24*m* of each leg is channel shaped and the fixed limb 24*f* is sized to be received in the channel of the fixed limb as shown. The parallel flanges 34 of the movable limb bracket the sides of the fixed limb (see FIG. 1) and are pivotally attached thereto by pivot pin 36 while the web 38 of the fixed limb rests against the exposed face of said fixed limb and cooperates therewith to define a stop limiting the degree to which the leg can be unfolded. Now, the lower end of each movable limb is provided with a downturned projecting lip 40 which may either be an integral extension of web 38 or a separate element. Either way, this lip is designed to slip down over the edge of shield flange 22 in the manner shown in FIG. 2 while the flanges of the movable limb rest atop thereof. The coaction between the fixed and movable limbs is such that the fully unfolded position of the legs is that which is shown in FIG. 2.

Detachably mounted within the throat 42 of collar 26 and in coaxial relation thereto is a nozzle element 44 having an upper cylindrical section 46 and a lower tapered section 48 of a generally frustoconical shape. Projecting downwardly and outwardly in divergent relation from the outside of the nozzle are three legs 50 spaced about 120° apart. The lower extremities 52 of these legs are bent into parallelism with respect to one another and notched on the underside as shown at 54 to receive mounting studs 56 projecting radially inward from inside the collar 26, all of which is most clearly revealed in FIG. 1. With the nozzle supported within the throat 42 of the collar as shown in FIGS. 2, 3 and 4, an annular space 56 is left therebetween through which fresh outside air is sucked when the blower subassembly that has been generally indicated by reference numeral 58 is mounted in place and turned on. The taper of section 48 of the nozzle is such as to increase the velocity of the air being blown therethrough. The resulting venturi becomes operative to create a reduced pressure condition within the throat of collar 26 which, in turn, draws in fresh air from the atmosphere which is sucked down the duct into the area being ventilated. Tests have shown that the assembly shown herein delivers approximately $2\frac{1}{2}$ times the total volume of air to the underground installation that the blower itself is capable of delivering.

The blower subassembly 12 comprises a cylindrical housing 60 containing a conventional 12 volt direct current blower motor 62 recessed therein and operative to drive a fan (not shown). In operation, the fan inspirates fresh atmospheric air across rim 64 and directs it down the motor housing into nozzle 44 where these elements cooperate with one another and with collar 26 to inspirate additional air from the atmosphere in the manner already explained. Power to operate the blower is derived from a self-contained generator (not shown) of the type commonly carried in the service truck of 12 volt DC battery.

The blower housing 60 and nozzle 44 are shown as comprising separate elements and obviously they could, if desired, be combined into a single unitized structure; however, as will appear presently, there are certain advantages to having them separate. Encircling the blower housing is a pair of rings 66 arranged in axially-spaced relation and interconnected by a handle 68. The portions of these rings 66 opposite the handle are each provided with spaced apart feet 70 which cooperate in the manner shown in FIG. 5 to support the blower on the ground with its axis extending horizontally instead of vertically. A smaller diameter hose 72 is attached to the outlet of the blower and placed in the open manhole 14 for purposes of ventilating same after it has been purged of foul air. Also, the size of blower hose 72 relative to the manhole opening is such as to permit the workmen to enter the latter which cannot be done under most circumstances with the large duct in place.

In FIGS. 2, 3 and 4, it can be seen that the lower of the two housing-encircling rings 66 also defines a stop limiting the penetration of the nose of the housing down into the cylindrical section 46 of the nozzle which receives the latter telescopically with a rather loose fit. The two-part construction of the nozzle and blower subassembly permits the blower to be removed for use in other applications where a portable source of forced air is needed without having to dismantle the rest of the unit. Also, since the nozzle serves no useful purpose when connected to a small diameter hose as in FIG. 5 and, in fact, somewhat restricts the flow, it is preferable to use the full diameter of the blower outlet.

Again with reference to FIG. 2, one of the most significant features of the present invention is the deflector 74 sitting atop collar 26. The fresh clean air drawn into the collar and forced down through duct 30 pushes the foul air out through the annular space 76 between the duct and manhole rim (or shield if one is used) where it impinges against the underside of an outwardly-curved deflector. This deflector functions to deflect the foul air thus removed to a location where it cannot be sucked back underground, at least not until it is sufficiently diluted with fresh air so as to no longer constitute a threat to the health or safety of those workmen breathing it. A deflector having a curvature of at least approximately 90° has proven to be adequate for this purpose although one having a greater curvature than 90° such as the 180° one illustrated has proven to be even more effective. Also, a curved deflector has been found to be somewhat more effective than a simple flared or frustoconical one.

The deflector 74 has, unexpectedly, been found to have a considerable influence on the volume of air inspirated into the throat 42 of the collar 26 with the one curved as shown proving most effective in this regard; whereas, flared deflectors or the total absence of any deflector have resulted in considerably reduced air flow.

Finally, a few important relationships are worthy of special mention. To begin with, the area of the narrowest annular space through which the purged air must exit should, by all means, be sufficient to easily handle the total volume of air entering the installation through duct 30 otherwise, obviously, there will be some loss in efficiency of the system. Along this same line, the ability of the system to inspirate a maximum volume of fresh air seems, up to a point, to bear a relationship to the length of duct 30. For instance, a duct having an inside diameter of around 18 inches with a length of 6 feet or so performs quite well in a 27 inch diameter manhole while shorter ducts result in a certain loss in air volume. It appears, therefore, that the duct, collar and deflector all cooperate to produce a most important and beneficial reverse draft (opposite to that of a chimney) effective to inspirate additional fresh air. Unexpectedly, the concave upper surface of the deflector also seems to have a beneficial effect upon the volume of fresh air inspirated by the system when compared to deflector having other shapes.

What is claimed is:

1. For use in combination with a rimmed vertical entryway into a space to be ventilated, the assembly which comprises: an endless collar having upper and lower open ends and a wall shaped to fit within the entryway and leave an annular gap therebetween for the passage of exhaust air, gap-bridging means depending from the collar operative to support the latter within the rimmed entryway without appreciably obstructing the flow therebetween, a tapered nozzle centered within the collar so as to leave a space therebetween, a forced air blower connected to the nozzle operative to direct a stream of air downwardly therethrough, a duct hanging from the underside of the collar forming an elongate continuation thereof, and an upwardly and outwardly flared deflector bordering the upper open end of the collar, said nozzle and collar cooperating with one another and with the blower when the latter is operative to aspirate air into the duct over the top of the deflector, and said deflector being effective to turn the air exhausted through the annular gap aside so no significant quantity thereof will be reaspirated into the duct.

2. The assembly as set forth in claim 1 wherein the gap-bridging means comprise foldable legs movable from an unfolded position engageable with the entryway rim and a folded position tucked under the collar, wherein the duct is longitudinally collapsible into a compact position beneath the collar, and wherein said legs in folded position support the duct in collapsed condition.

* * * * *